US008139008B2

(12) United States Patent
Huang et al.

(10) Patent No.: US 8,139,008 B2
(45) Date of Patent: Mar. 20, 2012

(54) BI-STABLE DISPLAY SYSTEMS AND DRIVING METHODS THEREOF

(75) Inventors: Chieh-Yi Huang, Hsinchu County (TW); Chao-Kai Cheng, Miaoli County (TW); Yuh-Zheng Lee, Hsinchu (TW); Jyh-Wen Shiu, Hsinchu County (TW); Yuan-Chang Liao, Yunlin County (TW)

(73) Assignee: Industrial Technology Research Institute, Hsinchu (TW)

( * ) Notice: Subject to any disclaimer, the term of this patent is extended or adjusted under 35 U.S.C. 154(b) by 672 days.

(21) Appl. No.: 12/368,927

(22) Filed: Feb. 10, 2009

(65) Prior Publication Data

US 2010/0110343 A1 May 6, 2010

(30) Foreign Application Priority Data

Nov. 5, 2008 (TW) ..... 97142639 A

(51) Int. Cl.
*G09G 3/34* (2006.01)

(52) U.S. Cl. ..... 345/85; 345/88

(58) Field of Classification Search ..... None
See application file for complete search history.

(56) References Cited

U.S. PATENT DOCUMENTS

| | | | | |
|---|---|---|---|---|
| 7,167,167 | B2 | 1/2007 | Capurso et al. | |
| 7,360,688 | B1 | 4/2008 | Harris | |
| 2006/0097957 | A1 | 5/2006 | Ben-Shalom | |
| 2006/0170981 | A1 | 8/2006 | Ricks et al. | |
| 2008/0150885 | A1 * | 6/2008 | Overwijk et al. | 345/107 |

* cited by examiner

*Primary Examiner* — Paul Huber

(57) ABSTRACT

Bi-stable display systems and driving methods thereof are presented. The bi-stable display system includes a bi-stable display panel having at least one substrate, at least one electrode disposed on the substrate, and a bi-stable display medium between the at least one electrode, wherein the at least one electrode extends to pluralities of electrode pads on the at least one side of peripheral regions. A data input device for inputting display data to the bi-stable display panel includes a plurality of input terminals corresponding to the electrode pads of the bi-stable display panel. A trigger device detects relative movement between the bi-stable display panel and the data input device and generates a trigging signal to shift data address in a data shifter, thereby renewing image data in the bi-stable display panel.

10 Claims, 7 Drawing Sheets

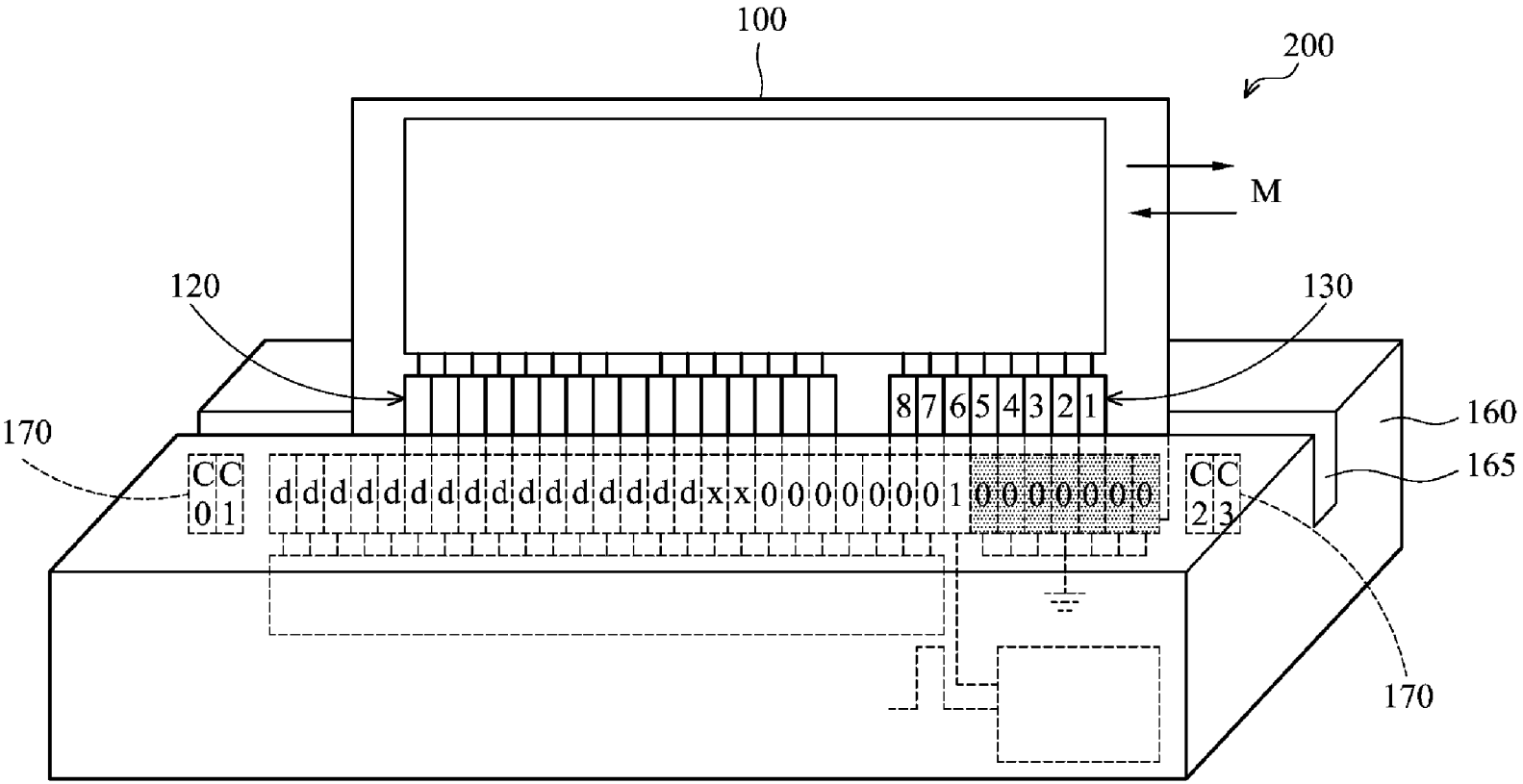
200
M
100
130
160
165
170
120
170
CC
23
CC
01
1
2
3
4
5
6
7
8
0
0
0

BI-STABLE DISPLAY SYSTEMS AND DRIVING METHODS THEREOF

CROSS REFERENCE TO RELATED APPLICATIONS

This application is based upon and claims the benefit of priority from a prior Taiwanese Patent Application No. 097142639, filed on Nov. 5, 2008, the entire contents of which are incorporated herein by reference.

BACKGROUND OF THE INVENTION

1. Field of the Invention

The invention relates to display systems, and in particular to bi-stable display systems and driving methods thereof.

2. Description of the Related Art

Liquid crystal display (LCD) devices have many advantages such as a small size, light weight and low power consumption, and are applicable in a variety of electronic and communication devices including notebook computers, personal digital assistants (PDA), mobile phones and the like due to its light weight, thin profile, and portability.

Conventional reflective memorable color liquid crystal display devices are widely applicable in electronic books, electronic papers, and the likes. When operating, the conventional bi-stable display devices, such as a cholesteric liquid crystal display device, a driving voltage is applied only when renewal of display data is needed. After driving voltage is applied, arrangements of the liquid crystal are changed, thereby generating different spectrum scatterings to achieve display of color images. Particularly, after the display frame is renewed, the display data can be held steady. Since, the sustained voltage can be released, no power consumption is needed to hold the display data in the display frame, thus applicable display devices are known as bi-stable display devices.

Driving characteristics of bi-stable display devices display non-dynamic image data. Specifically, only when renewal of display frames is needed, then electrical potential is applied to the display devices. However, when considering application in flexible, roll, large-scale display devices, display mechanism requirements are different from conventional display related arts.

FIG. 1 is a schematic view illustrating a structure of a conventional bi-stable display device. Referring to FIG. 1, a conventional bi-stable display device includes a plurality of longitudinal electrodes 17 and a plurality of transverse electrodes 12, respectively extending to peripheral regions 11', 16' of the upper substrate 11 and lower substrate 16 of the display device. The aforementioned electrode structures 12 and 17 extend to terminals on two perpendicular lateral sides of both the upper and lower substrates of the display device. The terminals are respectively scanning electrode pads 18 and data electrode pads 13.

Conventional driving method for bi-stable display devices includes connecting both the abovementioned electrode pads 13 and 18 to fixed driving chips 22 and 24. Image data is then transmitted to each of the electrode pads 13 and 18 through the driving chips, thereby renewing display data and frames.

U.S. Pat. No. 7,167,167, the entirety of which is hereby incorporated by reference, discloses a data input system for electronic price tags. Predetermined electrode pads are formed on the peripheral regions of a bi-stable display device. Corresponding electrode pads are also formed on another data input device. When the bi-stable display device and the data input device are in contact, the renewal of a display frame on the bi-stable display device can be completed. When combined, the bi-stable display device is designed to mechanically fix to and contact with the data input device. After renewal is completed, the bi-stable display device is detached from the data input device. The bi-stable display device is a circuit free display device.

U.S. Pub. No. 2006/0170981, the entirety of which is hereby incorporated by reference, discloses a driving method for renewing images of the bi-stable display devices using a roller. The driving method includes applying voltage on a bi-stable display device using a roller with a conductive electrode thereon. When the roller contacts the electrodes on the bi-stable display devices, image data is transmitted to the bi-stable display device to renew a display frame thereon.

U.S. Pat. No. 7,360,688, the entirety of which is hereby incorporated by reference, discloses a mechanism for inputting data in credit cards with a display. An input/output interface for a scrip machine is formed on a lateral side of the credit cards. A point-to-point contact method is used to renew a display frame, and a serial input method is used to transmit the renewed data. The bi-stable display device includes a processor and a memory unit.

Moreover, U.S. Pub. No. 2006/0097957, the entirety of which is hereby incorporated by reference, discloses a display system which includes a combination of several sub-display panels. Each sub-display panel includes electrode contacts, wherein the electrodes of substrates are extended to the same lateral side of the sub-display panel devices in the layout design. After each sub-display panel is arranged and formed into a large scale display device system, image data are controlled by a central control unit and respectively transmitted to each sub-display panel.

BRIEF SUMMARY OF THE INVENTION

Embodiments of the invention provide a bi-stable display system, comprising: a bi-stable display device having at least one substrate, at least one electrode disposed on the substrate corresponding to a display area of the bi-stable display device, and a bi-stable display medium between the at least one electrode, wherein the at least one electrode extends to a plurality of electrode pads on the same side of peripheral regions of the substrate; and a data input device including a contact region with the sliding electrode pad, a data shifter, a trigger device, and at least one driving module, wherein the data shifter inputs data to the bi-stable display device, the contact region with the sliding electrode pad includes a plurality of input terminals corresponding to the electrode pads of the bi-stable display device, and the trigger device detects relative movement between the bi-stable display device and the data input device and generates a trigging signal to shift data address in a data shifter, thereby renewing image data in the bi-stable display panel.

Embodiments of the invention also provide a driving method for a bi-stable display system, comprising: providing a bi-stable display device having a plurality of data electrodes and scanning electrodes, wherein each of data electrodes and scanning electrodes extend to a plurality of electrode contact pads on the same side of the peripheral region of the bi-stable display device; and sliding the bi-stable display device through a contact region with the sliding electrode pads of a data input device to renew display images, wherein the data input device comprises a data shifter, a trigger device, and at least one driving module, and the trigger device is trigged when the bi-stable display device is slid and when the relative movement of the bi-stable display device is sensed, thereby generating a trigging signal to shift image data corresponding to each scan electrode in the data shifter to complete renewal of display images.

BRIEF DESCRIPTION OF THE DRAWINGS

The invention can be more fully understood by reading the subsequent detailed description and examples with references made to the accompanying drawings, wherein:

FIG. 3 is a schematic view illustrating an embodiment of a bi-stable display system of the invention;

DETAILED DESCRIPTION OF THE INVENTION

Figure 1:
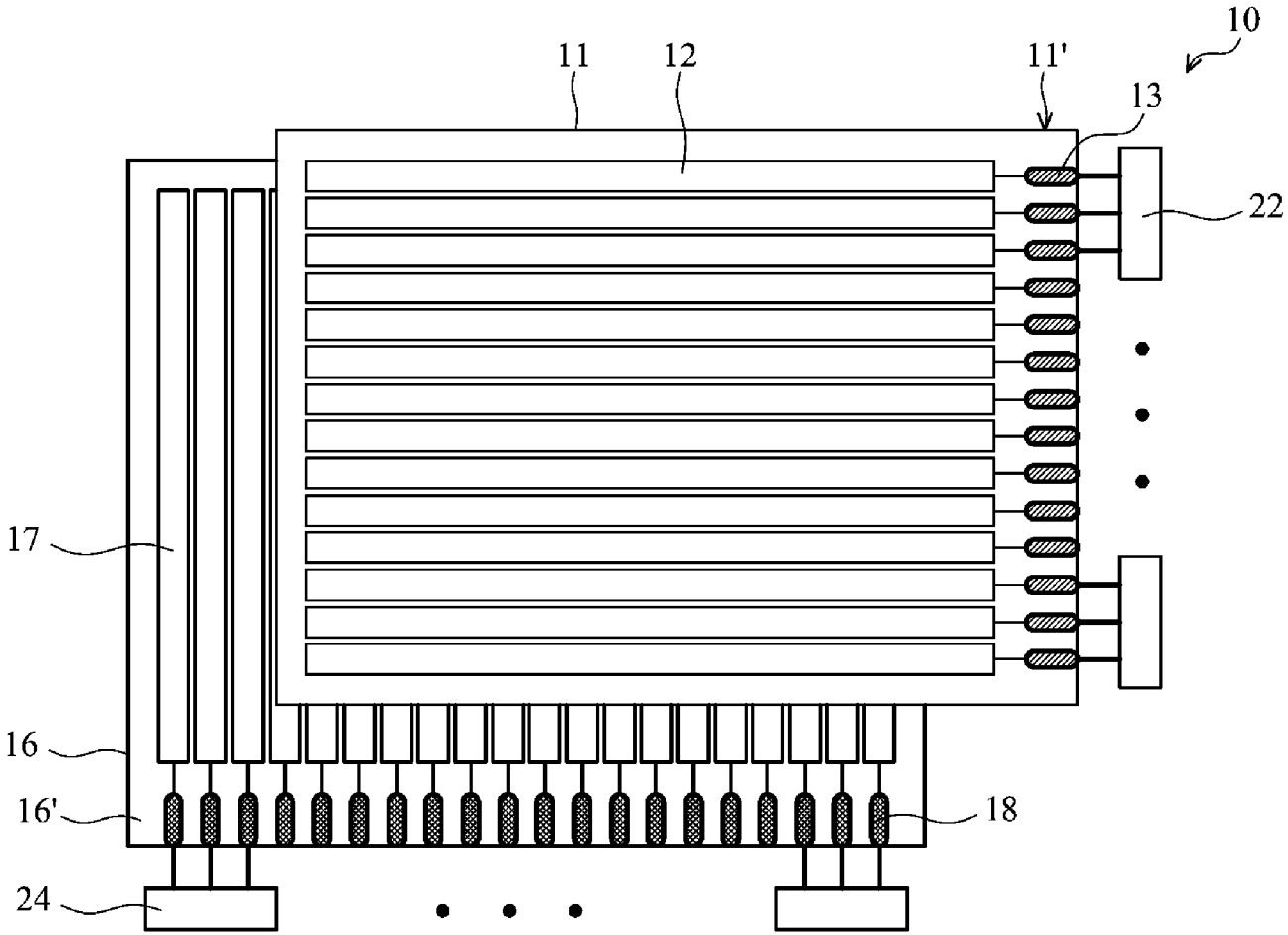
FIG. 1 ( PRIOR ART )
FIG. 1 is a schematic view illustrating a structure of a conventional bi-stable display device.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself indicate a relationship between the various embodiments and/or configurations discussed. Moreover, the formation of a first feature over or on a second feature in the description that follows may include embodiments in which the first and second features are formed in direct contact or not in direct contact.

An embodiment of the invention provides a bi-stable display system including a bi-stable display device and a data input device and a driving method for renewing the display images and date of the bi-stable display system. The bi-stable display system is characterized by the display frame and image data changing when voltage differences are applied. That is, when no voltage is applied, image data is sustained. More specifically, image data is sequentially scanned and input through relative movement between the bi-stable display device and the data input device. When image data is required to be renewed, the electrodes of data lines and scan lines on the bi-stable display device contact the electrode pads on the data input device. When a relative movement occurs between the bi-stable display device and a data input device, i.e., the electrode pads of the bi-stable display device and electrode pads of the data input device relatively moves a pitch interval, each electrode pad of the bi-stable display device contact a corresponding electrode pad of the data input device. Therefore, the image data on the scan line electrodes are sequentially renewed, until all data on the display device are completely renewed.

According to a specified embodiment of the invention, a bi-stable display system includes a bi-stable display device and a data input device, wherein the bi-stable display device has a plurality of first electrode contacts, referred to as data electrode pads, and a plurality of second electrode contacts, referred to as scan electrode pads. A data input device allows inputting of data and driving of the bi-stable display device. The data input device includes a contact region with the sliding electrode pads, a data shifter, a trigger device, and a driving module. The date shifter includes an image processing and encoding unit, a data memory unit, a scaler unit, a data shift register, and a counter unit.

According to another specified embodiment of the invention, a bi-stable display system includes a bi-stable display device and a data input device, wherein the bi-stable display device has a plurality of first electrode contacts, referred to as data electrode pads and a plurality of second electrode contacts, referred to as scan electrode pads. A data input device allows inputting of data and driving of the bi-stable display device. The data input device includes a contact region with the sliding electrode pads, a data shifter, a trigger device, and a driving module. The date shifter includes an image processing and encoding unit, a data memory unit, a scaler unit, a data shift register, and a counter unit. The abovementioned data electrode pads and scan electrode pads can be disposed on the same lateral side of peripheral region of the bi-stable display device. Alternatively, both the data electrode pads and scan electrode pads can also be disposed on the opposite lateral side of peripheral region of the bi-stable display device.

According to further another specified embodiment of the invention, a bi-stable display system includes a bi-stable display device and a data input device, wherein the bi-stable display device has a plurality of first electrode contacts, referred to as data electrode pads and a plurality of second electrode contacts, referred to as scan electrode pads. A data input device allows inputting of data and driving of the bi-stable display device. The data input device includes a contact region with the sliding electrode pads, a data shifter, a trigger device, and a driving module. The date shifter includes an image processing and encoding unit, a data memory unit, a scaler unit, a data shift register, and a counter unit. The abovementioned data electrode pads and scan electrode pads can be disposed on the same lateral side of peripheral region of the bi-stable display device. Alternatively, both the data electrode pads and scan electrode pads can also be disposed on the opposite lateral side of peripheral region of the bi-stable display device. At least one data signal and scan signal input electrode pads correspond to the data electrode pads and scan electrode pads of the bi-stable display device and can be disposed in the contact region with the sliding electrode pads.

According to still another specified embodiment of the invention, a bi-stable display system includes a bi-stable display device and a data input device, wherein the bi-stable display device has a plurality of first electrode contacts, referred to as data electrode pads and a plurality of second electrode contacts, referred to as scan electrode pads. A data input device allows inputting of data and driving of the bi-stable display device. The data input device includes a contact region with the sliding electrode pads, a data shifter, a trigger device, and a driving module. The date shifter includes an image processing and encoding unit, a data memory unit, a scaler unit, a data shift register, and a counter unit. The abovementioned data electrode pads and scan electrode pads can be disposed on the same lateral side of peripheral region of the bi-stable display device. Alternatively, both the data electrode pads and scan electrode pads can also be disposed on the opposite lateral side of peripheral region of the bi-stable display device. At least one data signal and scan signal input electrode pads correspond to the data electrode pads and scan electrode pads of the bi-stable display device can be disposed in the contact region with the sliding electrode pads. When the bi-stable display device moves, the data signal and scan signal input electrode pad serve as contact electrodes of the scan electrode pads of the bi-stable display device. Simultaneously, the trigger device includes several trigging electrodes serving to generate trigging signals and determining movements of the scan electrode pads.

According to yet another specified embodiment of the invention, a bi-stable display system includes a bi-stable display device and a data input device, wherein the bi-stable display device has a plurality of first electrode contacts, referred to as data electrode pads and a plurality of second electrode contacts, referred to as scan electrode pads. A data input device allows inputting of data and driving of the bi-stable display device. The data input device includes a contact region with the sliding electrode pads, a data shifter, a trigger device, and a driving module. The date shifter includes an image processing and encoding unit, a data memory unit, a scaler unit, a data shift register, and a counter unit. The above-mentioned data electrode pads and scan electrode pads can be disposed on the same lateral side of peripheral region of the bi-stable display device. Alternatively, both the data electrode pads and scan electrode pads can also be disposed on the opposite lateral side of peripheral region of the bi-stable display device. At least one data signal and scan signal input electrode pads correspond to the data electrode pads and scan electrode pads of the bi-stable display device and can be disposed in the contact region with the sliding electrode pads. When the bi-stable display device moves, the data signal and scan signal input electrode pad serve as contact electrodes of the scan electrode pads of the bi-stable display device. Simultaneously, the trigger device includes several trigging electrodes serving to generate trigging signals and determining movements of the scan electrode pads. The driving module can be composed of driving circuits which include a data electrode driving circuit and electrode driving circuit. The output ends of the driving circuits connect to the electrode pads to input data signals and scan signals.

Figure 2:
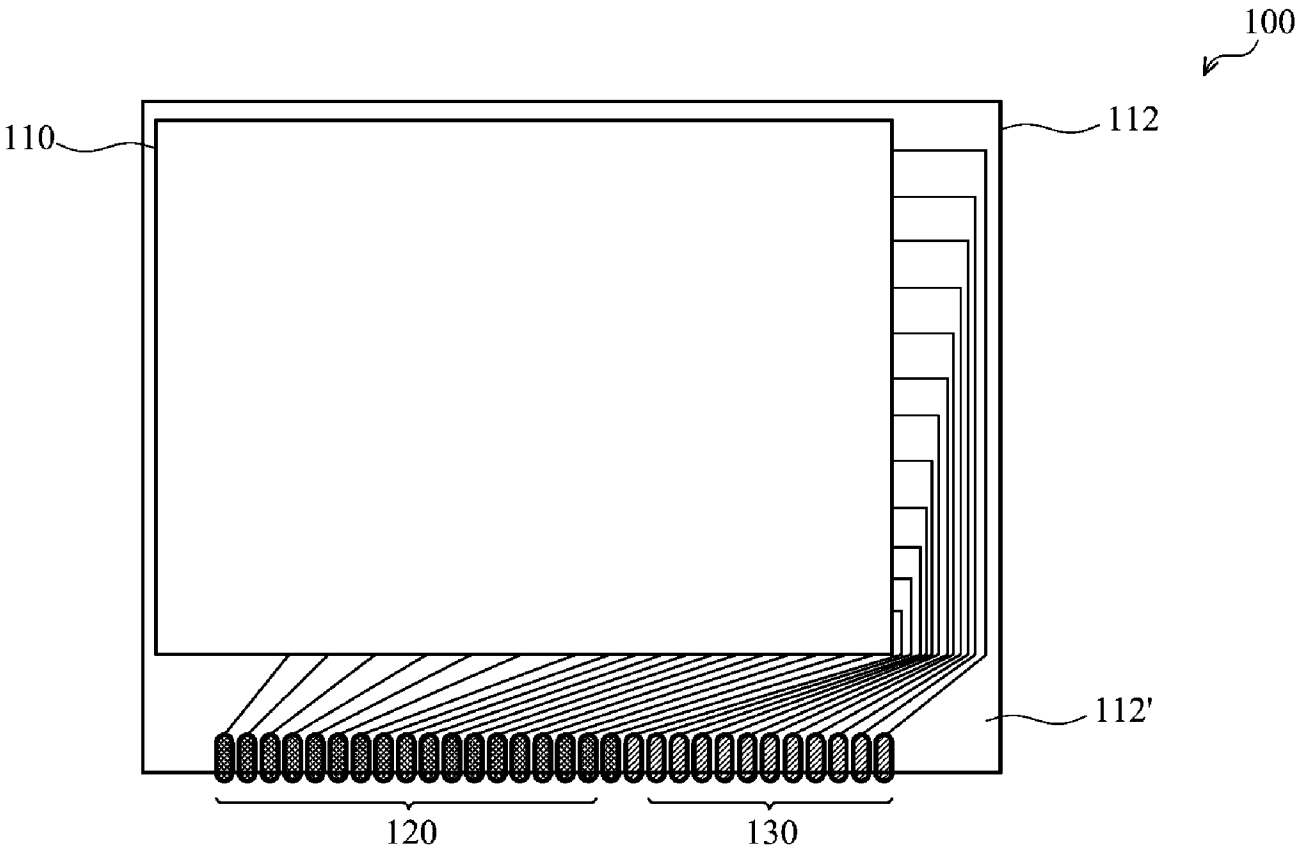
FIG. 2 is a schematic view illustrating an embodiment of a structure of a bi-stable display device of the invention.

FIG. 2 is a schematic view illustrating an embodiment of a structure of a bi-stable display device of the invention. Referring to FIG. 2, a bi-stable display device 100 includes a plurality of data electrodes 120 and scanning electrodes 130, wherein each of data electrodes and scanning electrodes extending to the same side of the peripheral region 112' of the substrate 112 of the bi-stable display device 100. The bi-stable display device 100 can be a cholesteric liquid crystal display device with a display region 110 showing at least one color.

FIG. 3 is a schematic view illustrating an embodiment of a bi-stable display system of the invention. Referring to FIG. 3, a bi-stable display system 200 includes a bi-stable display device 100 and a data input device 160, wherein the bi-stable display device has a plurality of first electrode contacts, referred to as data electrode pads 120 and a plurality of second electrode contacts, referred to as scan electrode pads 130. The data input device 160 includes a contact region 165 with sliding electrode pads, and the bi-stable display device 110 slides through the contact region 165. A driving controller serves as a means for controlling and driving the bi-stable display device. According to one embodiment of the invention, when a relative movement M occurs between the bi-stable display device 100 and the data input device 160, a trigger device 170 initiates a trigging signal. The status of the display medium in the bi-stable display device is changed by applying voltage or current to achieve switching of images. Note that the trigger device 170 includes a mechanical trigger, an optical trigger, an electrical trigger, or a magnetic trigger. In this embodiment, both data line and scan line electrode pads can be disposed on the same side of the bi-stable display device which relatively moves against the data input device to input image data.

Figure 4A:
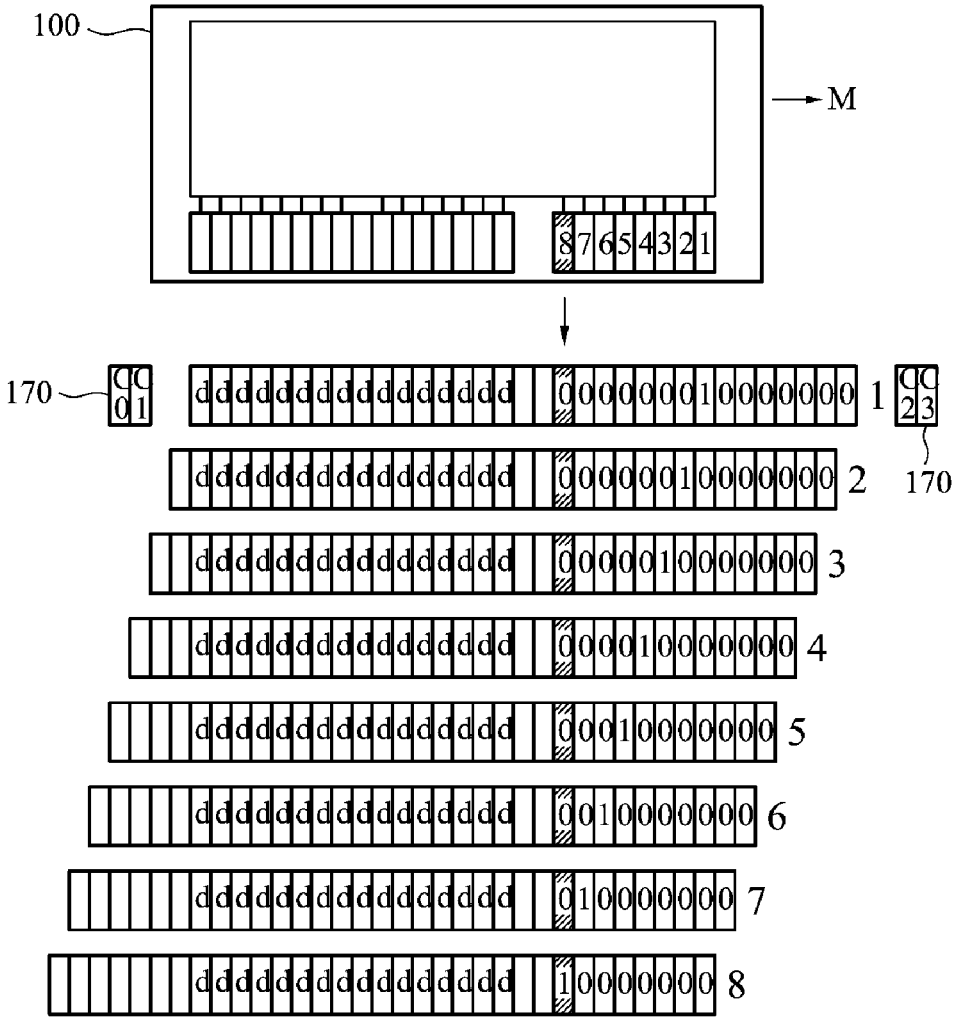
FIG. 4A shows relative relationships between data signals and scan signals at eight time intervals when the bi-stable display device is sliding through the data input device.
Figure 4B:
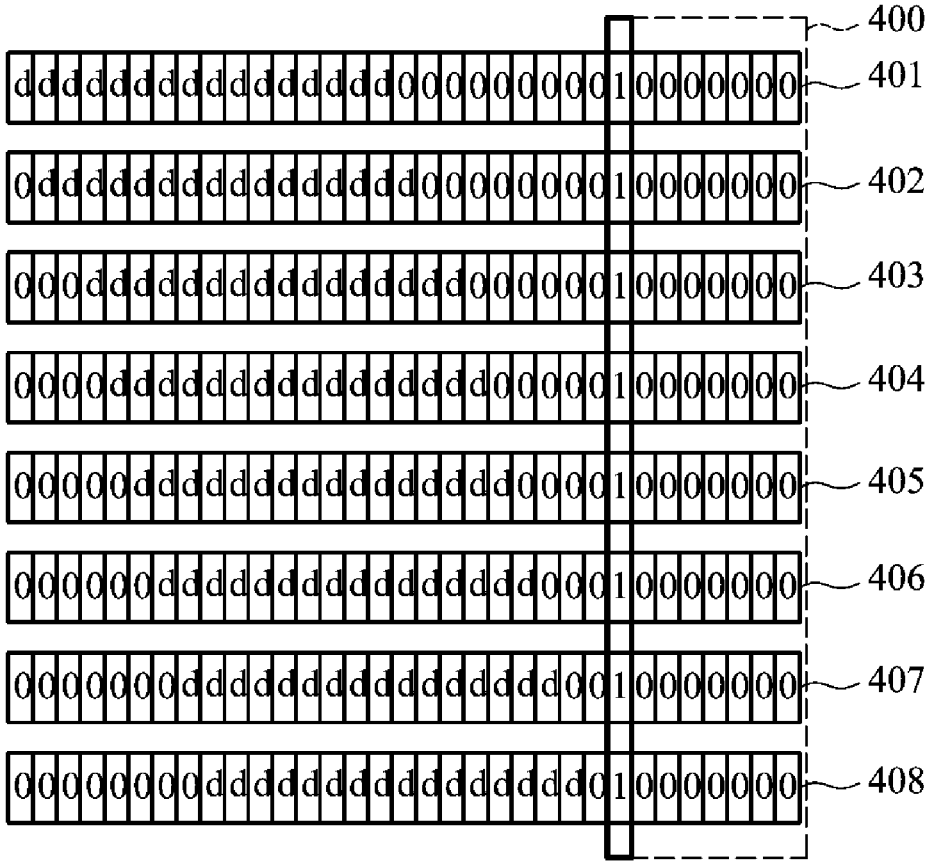
FIG. 4B shows summarized results of the relative relationships between data signals and scan signals at eight time intervals when the bi-stable display device is sliding through the data input device.

When a relative movement occurs between the scan line electrode pads and electrode pads of the data input device, signal status changes, as shown in FIG. 4A and FIG. 4B. FIG. 4A shows relative relationships between data signals and scan signals at eight time intervals when the bi-stable display device is sliding through the data input device. FIG. 4B shows summarized results of the relative relationships between data signals and scan signals at eight time intervals when the bi-stable display device is sliding through the data input device, in which all of the eight signal statuses are at a digital '0' state in the dotted line frame 400, and all of the eight signal statuses are at a digital '1' state in the solid line frames 401-408.

Figure 4C:
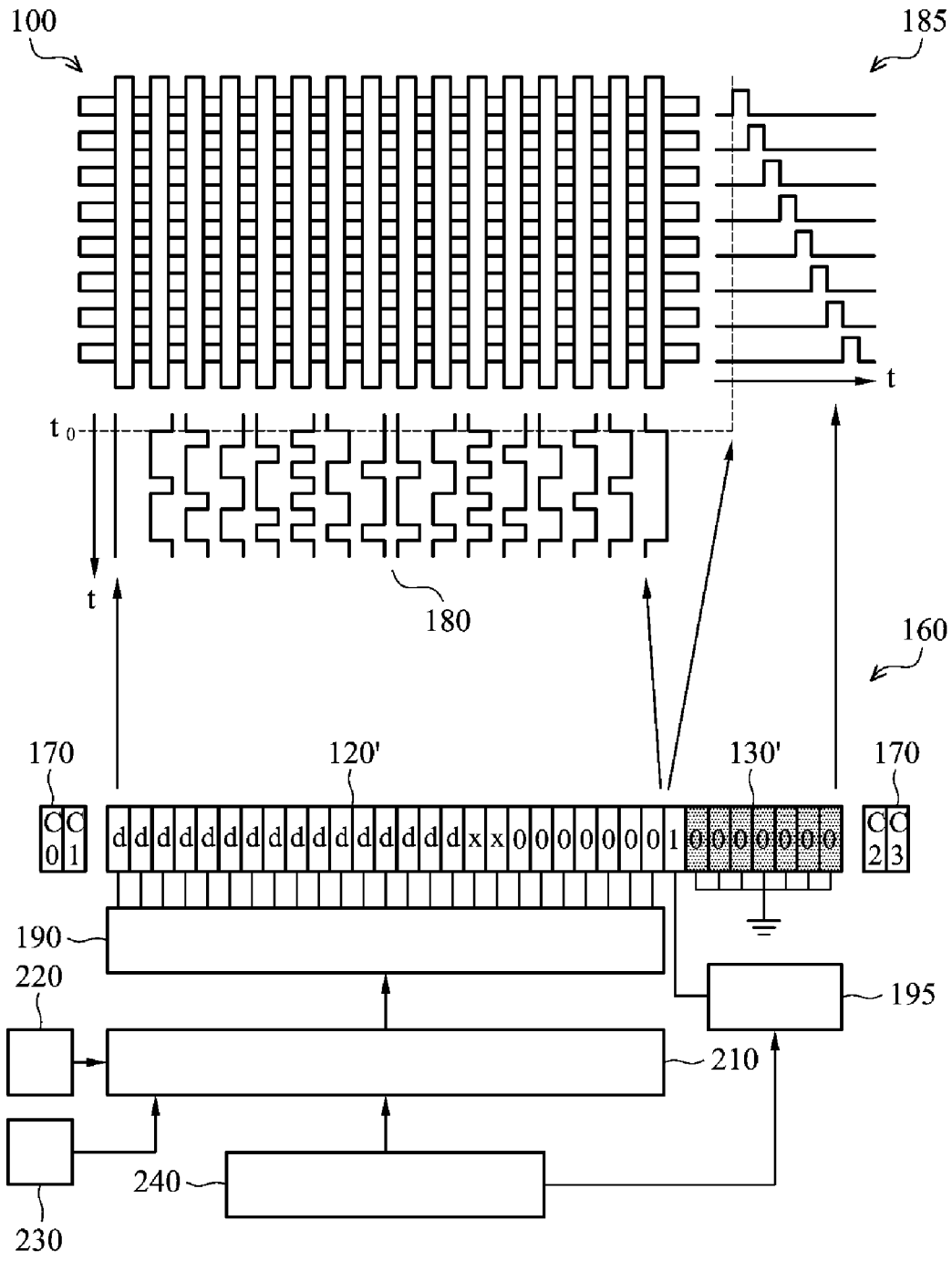
FIG. 4C is a schematic diagram illustrating an embodiment of an inner module structure of the data input device and a signal relationship with the bi-stable display device.

FIG. 4C is a schematic diagram illustrating an embodiment of an inner module structure of the data input device and a signal relationship with the bi-stable display device. Referring to FIG. 4C, a data input device 160 includes data line electrode pads 120' and scan line electrode pads 130' corresponding to the bi-stable display device and a trigger device 170. When data contents in the display device are changed, a relative movement occurs between the bi-stable display device and the data input device. At the direction along the movement of the bi-stable display device, the trigger device 170 detects the relative locations of the bi-stable display device and generates a trigger signal to shift data in the data shifter 210. Data line signals 180 and scan line signals 185 are transmitted to the bi-stable display device 100, thereby renewing image data on the corresponding scan lines.

Note that the data line electrode pads 120' and scan line electrode pads 130' of the data input device 160 are respectively connected to a data line driving circuit 190 and a scan line driving circuit 195 of the driving module. After the data shifter 210 receives input image data 220 and the trigger device analyzes directional signals 230 of the bi-stable display device movement, data in the data shifter 210 is moved. The trigger signal analyzed by the trigger device determines whether to trigger an alignment signal 240 respectively to the scan line driving circuit 195 and the data shift register, such that corresponding data are output to the data line driving circuit 190.

Figure 5:
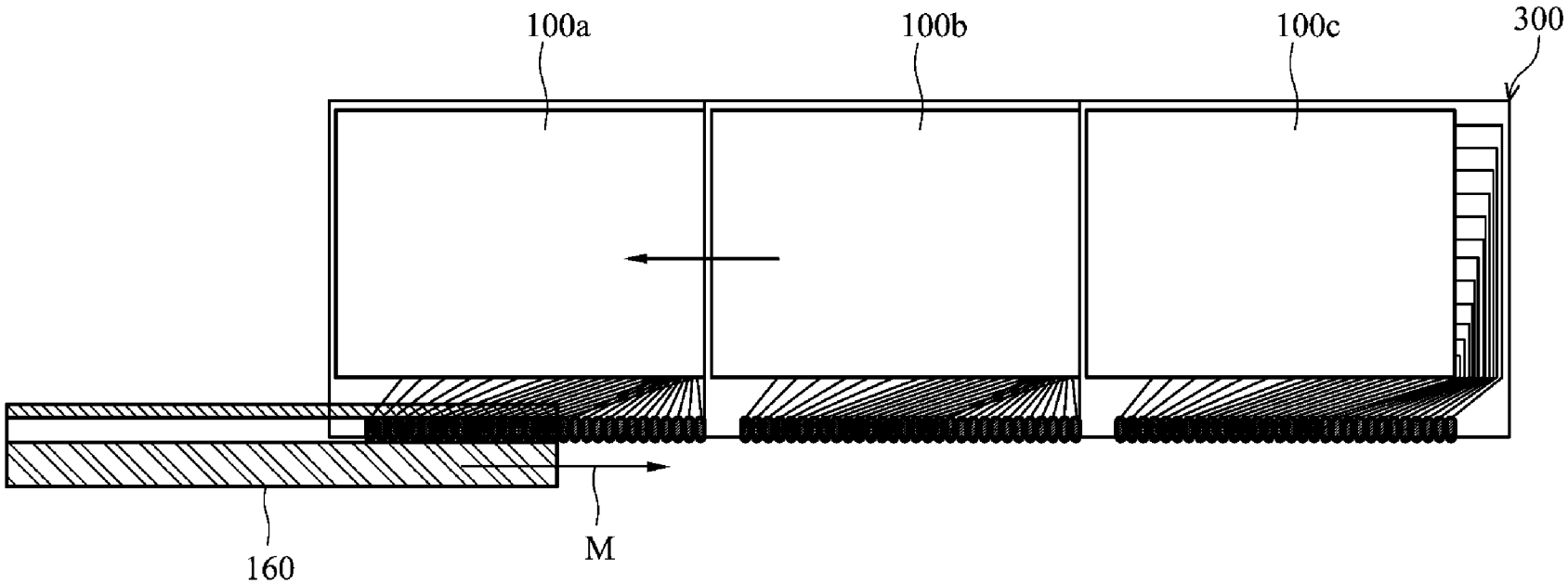
FIG. 5 is a schematic diagram illustrating electrode layout of an embodiment of the bi-stable display device attached by several sub-panels.

FIG. 5 is a schematic diagram illustrating electrode layout of an embodiment of the bi-stable display device attached by several sub-panels. Referring to FIG. 5, a large scale bi-stable display device set 300 can be attached by several bi-stable display sub-panels 100*a*, 100*b*, and 100*c*. A large frame image data can thus be renewed by moving the bi-stable display device set 300 relative to the data input device 160 along a moving direction M.

While the invention has been described by way of example and in terms of the several embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A bi-stable display system, comprising:

a bi-stable display device having at least one substrate, at least one electrode disposed on the substrate corresponding to a display area of the bi-stable display device, and a bi-stable display medium between the at least one electrode, wherein the at least one electrode extends to a plurality of electrode pads on the at least one side of peripheral regions of the substrate; and a data input device including a contact region with sliding electrode pad, a data shifter, a trigger device, and at least one driving module, wherein the data shifter inputs data to the bi-stable display device, wherein the contact region with sliding electrode pad includes a plurality of input terminals corresponding to the electrode pads of the bi-stable display device, and wherein the trigger device detects relative movement between the bi-stable display device and the data input device and generates a trigging signal to shift data address in a data shifter, thereby renewing image data in the bi-stable display panel.

2. The bi-stable display system as claimed in claim 1, wherein the image data of the bi-stable display device is input by applying voltage or current to change a state of the bi-stable display medium, thereby switching images.

3. The bi-stable display system as claimed in claim 1, wherein the trigger device comprises a mechanical trigger, an optical trigger, an electrical trigger, or a magnetic trigger.

4. The bi-stable display system as claimed in claim 1, wherein the a data input device includes a contact region with sliding electrode pad, and wherein the bi-stable display device relatively moves along arrangement of the plurality of electrode contact pads in the contact region with sliding electrode pad, during renewing display images.

5. The bi-stable display system as claimed in claim 1, wherein the bi-stable display device is a cholesteric liquid crystal display capable of displaying at least one color.

6. The bi-stable display system as claimed in claim 1, wherein terminals of the plurality of the electrode on the bi-stable display device extends to the plurality of electrode contact pads on the same side of the peripheral region or an opposite side peripheral region of the at least one substrate.

7. The bi-stable display system as claimed in claim 1, wherein the bi-stable display device comprises a plurality of small liquid crystal display panels attached together.

8. A driving method for a bi-stable display system, comprising:

providing a bi-stable display device having a plurality of data electrodes and scanning electrodes, each of data electrodes and scanning electrodes extending to a plurality of electrode contact pads on the at least one side of the peripheral region of the bi-stable display device; and sliding the bi-stable display device through a contact region with sliding electrode pads of a data input device to renew display images, wherein the data input device comprises a data shifter, a trigger device, and at least one driving module, and wherein the trigger device is trigged when the bi-stable display device is slid and the relatively movement of the bi-stable display device is sensed, thereby generating a trigging signal to shift image data corresponding to each scan electrode in the data shifter and to complete renewal of display images.

9. The driving method as claimed in claim 8, wherein the bi-stable display device is put in the contact region with sliding electrode pads, relatively moving along arrangement of the plurality of electrode contact pads.

10. The driving method as claimed in claim 8, wherein image data in data shifter comprises at least one set of frame data which are separately transmitted to a plurality of small liquid crystal display panels when the bi-stable display device is slid.

* * * * *